US011644236B2

(12) United States Patent
Morimoto et al.

(10) Patent No.: US 11,644,236 B2
(45) Date of Patent: May 9, 2023

(54) VACUUM FREEZE-DRYING APPARATUS AND VACUUM FREEZE-DRYING METHOD

(71) Applicant: MII, LTD., Osaka (JP)

(72) Inventors: Shuji Morimoto, Osaka (JP); Makoto Takehara, Osaka (JP)

(73) Assignee: MII, LTD., Osaka (JP)

( * ) Notice: Subject to any disclaimer, the term of this patent is extended or adjusted under 35 U.S.C. 154(b) by 0 days.

(21) Appl. No.: 17/919,746

(22) PCT Filed: May 18, 2021

(86) PCT No.: PCT/JP2021/018879
§ 371 (c)(1),
(2) Date: Oct. 19, 2022

(87) PCT Pub. No.: WO2021/235459
PCT Pub. Date: Nov. 25, 2021

(65) Prior Publication Data

US 2023/0100406 A1 Mar. 30, 2023

(30) Foreign Application Priority Data

May 18, 2020 (JP) ..... JP2020-086652

(51) Int. Cl.
*F26B 5/06* (2006.01)
*F26B 17/20* (2006.01)

(52) U.S. Cl.
CPC ..... *F26B 5/06* (2013.01); *F26B 17/20* (2013.01)

(58) Field of Classification Search
CPC .... F26B 5/06; F26B 17/20; F26B 5/04; F26B 5/041; F26B 5/042; F26B 5/065
See application file for complete search history.

(56) References Cited

U.S. PATENT DOCUMENTS 236,677 A * 1/1881 Halsey ..... F26B 5/06 366/291
430,652 A * 6/1890 Jarrett ..... F26B 17/20 34/182

(Continued)

FOREIGN PATENT DOCUMENTS

CA 2834324 A1 * 11/2012 ..... C10L 5/366
CA 2949789 A1 * 12/2016 ..... B65G 33/18

(Continued)

OTHER PUBLICATIONS

International Search Report for PCT/JP2021/018879 dated Aug. 24, 2021.

(Continued)

*Primary Examiner* — Edelmira Bosques
*Assistant Examiner* — Bao D Nguyen
(74) *Attorney, Agent, or Firm* — Yokoi & Co., U.S.A.; Toshiyuki Yokoi

(57) ABSTRACT

Provided are a vacuum freeze-drying apparatus and a method capable of continuously performing vacuum freeze-drying in a short time. A vacuum freeze-drying apparatus 1 of this invention having an exhaust path for performing vacuum suction, while a drying device 3 comprises a tubular member 31 provided an inlet portion and an outlet portion formed of a tubular shape, a temperature adjusting means 30*a* to 30*j* provided in a plurality of regions formed from the inlet portion toward the outlet portion in a peripheral portion of the tubular member 31 wherein the plurality of regions are at least three or more regions whose temperature is capable of being controlled, for adjusting temperatures of a plurality of regions 40*a* to 40*j* in outer surface of the tubular member, a temperature control unit 8 for independently controlling the temperature adjusting means, and a rotating portion 7 for rotating the tubular member 31, wherein the tubular member 31 has a spiral transfer means 31*a* continuously provided (Continued)

adjacent to an inner wall of the tubular member from the inlet portion toward the outlet portion, and the transfer means 31*a* transfers the frozen substance sequentially to locations corresponding to the plurality of regions in the tubular member so as to continuously sublimate and dry.

4 Claims, 11 Drawing Sheets

(56) References Cited

U.S. PATENT DOCUMENTS 474,568 A * 5/1892 Weller ..... F26B 17/20 34/182
548,573 A * 10/1895 Moller et al. ..... F26B 5/06 34/76
676,165 A * 6/1901 Wacker ..... F26B 17/20 34/182
986,107 A * 3/1911 Wertenbruch ..... F26B 17/20 34/166
1,051,359 A * 1/1913 Wille ..... F26B 17/20 34/182
1,172,479 A * 2/1916 Motter ..... F27B 17/00 432/66
1,179,192 A * 4/1916 Kleinschmidt ..... F27B 17/00 34/79
1,303,982 A * 5/1919 Stevens ..... F26B 5/06 34/166
1,328,027 A 1/1920 Yai
1,735,393 A * 11/1929 Hiller ..... F26B 17/20 366/326.1
1,735,396 A * 11/1929 Hiller ..... F26B 17/20 34/387
2,038,904 A * 4/1936 Rand ..... F26B 17/20 366/183.2
2,067,506 A * 1/1937 Silva ..... F26B 17/20 34/166
2,388,917 A * 11/1945 Hormel ..... F26B 5/06 426/418
2,411,152 A * 11/1946 Folsom ..... F26B 5/06 264/5
2,515,098 A * 7/1950 Smith, Jr. ..... F26B 5/065 62/271
2,552,360 A * 5/1951 Zichis ..... F26B 5/06 241/97
2,616,604 A * 11/1952 Folsom ..... B01D 7/00 53/484
2,636,284 A * 4/1953 Napier ..... A23L 3/18 241/3
2,743,168 A * 4/1956 Krohn ..... B01D 7/00 423/19
2,751,687 A * 6/1956 Colton ..... B01J 2/00 264/28
2,803,888 A * 8/1957 Cerletti ..... F26B 5/06 34/305
3,088,222 A * 5/1963 Mace ..... F26B 5/06 34/92
3,264,747 A * 8/1966 Fuentevilla ..... F26B 3/34 219/679
3,266,169 A * 8/1966 Smith, Jr. ..... F26B 5/06 62/347
3,270,432 A * 9/1966 Barbareschi ..... B01D 7/00 34/305
3,310,881 A * 3/1967 Fritzberg ..... F26B 5/041 426/465
3,316,652 A * 5/1967 Van Gelder ..... F26B 5/06 34/292
3,324,565 A * 6/1967 Smith, Jr. ..... F26B 5/06 34/92
3,362,835 A * 1/1968 Thuse ..... A23F 5/32 159/4.06
3,445,247 A * 5/1969 Baerwald ..... F26B 5/06 426/640
3,469,327 A * 9/1969 Catelli ..... F26B 5/042 34/526
3,531,872 A * 10/1970 Watson ..... F26B 3/00 210/781
3,601,901 A * 8/1971 Rader ..... F26B 5/065 34/92
3,605,273 A * 9/1971 Andersen ..... F26B 5/041 34/92
3,612,411 A * 10/1971 Oetjen ..... F26B 5/06 241/24.1
3,616,542 A * 11/1971 Rader ..... F26B 5/065 34/92
3,952,541 A * 4/1976 Rigoli ..... A01N 1/0252 34/284
4,037,331 A * 7/1977 Brilloit ..... F26B 5/06 34/92
4,746,968 A * 5/1988 Wear ..... A23L 3/54 34/259
5,964,043 A * 10/1999 Oughton ..... F26B 5/06 34/92
6,098,410 A 8/2000 Horigane
7,140,122 B1 * 11/2006 Adams ..... F26B 5/041 34/361
8,978,268 B2 * 3/2015 Itou ..... F26B 5/065 34/291
10,006,706 B2 * 6/2018 Luy ..... F26B 5/065
10,627,162 B2 * 4/2020 Delaveau ..... F26B 11/0445
11,112,176 B2 * 9/2021 Nishihashi ..... F26B 5/065
11,175,093 B1 11/2021 Morimoto et al.
2007/0022626 A1 * 2/2007 Gomi ..... F26B 5/04 34/410
2008/0142166 A1 * 6/2008 Carson ..... B01D 1/18 159/7
2011/0192047 A1 * 8/2011 Itou ..... A23L 3/44 34/92
2014/0026434 A1 * 1/2014 Sawada ..... F26B 5/06 34/524
2017/0219283 A1 * 8/2017 Gebhard ..... A61K 9/19
2021/0080179 A1 * 3/2021 Nishihashi ..... F26B 17/16

FOREIGN PATENT DOCUMENTS

CN 110595193 A 12/2019
EP 2101131 A 9/2009
EP 2578974 A1 * 4/2013 ..... F26B 5/06
FR 3052544 A1 * 12/2017 ..... F26B 17/20
JP S47-21743 10/1972
JP S51-126557 11/1976
JP S55-112980 A 9/1980
JP H11-151080 A 6/1999
JP 2004232883 A * 8/2004
JP 3117061 U 1/2006
JP 2006177640 A * 7/2006
JP 2017-533397 A 11/2017
JP 6777350 B 10/2020
KR 2018-0086953 A 8/2018
WO WO-9629556 A1 * 9/1996 ..... F26B 5/06
WO 2010/005021 A 1/2010
WO WO-2010005021 A1 * 1/2010 ..... A23L 3/44
WO WO-2013036107 A2 * 3/2013 ..... F26B 5/06
WO 2013/050162 A 4/2013
WO WO-2018204484 A1 * 11/2018 ..... A23L 2/14
WO 2019/235036 A 12/2019
WO WO-2019235036 A1 * 12/2019 ..... A23L 3/001

OTHER PUBLICATIONS

PCT written opinion dated Aug. 24, 2021.
Japanese decision to grant a patent dated Dec. 6, 2022.

* cited by examiner

VACUUM FREEZE-DRYING APPARATUS AND VACUUM FREEZE-DRYING METHOD

TECHNOLOGY FIELD

The present invention relates to a vacuum freeze-drying apparatus and a vacuum freeze-drying method.

BACKGROUND TECHNOLOGY

Conventionally, a freeze-drying apparatus has been proposed in which droplets are produced, and the frozen particles freeze-solidified with the droplets are freeze-dried (Patent Document 1).

In addition, a freeze-drying apparatus has also been proposed in which a shelf for receiving frozen materials is tilted (Patent Document 2).

Further, a vacuum freeze-drying apparatus has been proposed in which frozen particles are sublimated and dried by the kinetic energy obtained at the time of spraying (Patent Document 3).

PRIOR ART DOCUMENTS

Patent Documents

Patent Document 1 International Opening WO2013/050162
Patent Document 2 International Opening WO2010/005021
Patent Document 3 International Opening WO2019/235036

SUMMARY OF THE INVENTION

Problem to be Solved by the Invention

However, in the above documents, there is a problem that vacuum freeze-drying cannot be continuously performed in a short time.

Therefore, the present invention has been made in view of the above problems and provides a vacuum freeze-drying apparatus and a vacuum freeze-drying method capable of continuously performing vacuum freeze-drying in a short time.

Solution to the Problem

In order to solve the above problems, (1) the present invention provides a vacuum freeze-drying apparatus comprising a vacuum freezing device for freezing a liquid, and a drying device for sublimating and drying a frozen substance frozen as above. The vacuum freeze-drying apparatus comprises an exhaust path for performing vacuum suction, and the drying device comprises a tubular member formed of a tubular shape provided with an inlet portion and an outlet portion, a temperature adjusting means provided in a plurality of regions formed toward a direction from the inlet portion to the outlet portion of a peripheral portion of the tubular member, wherein the plurality of regions are at least three or more regions whose temperature is capable of being controlled, and the temperature adjusting means adjusts a temperature of the plurality of regions in an outer surface of the tubular member, a temperature control unit for independently controlling the temperature adjusting means, and a rotating portion for rotating the tubular member. The tubular member has a spiral transfer means continuously provided adjacent to an inner wall of the tubular member toward a direction from the inlet portion to the outlet portion, and the transfer means transfers the frozen substance entering from the inlet portion sequentially to locations corresponding to the plurality of regions in the tubular member by the transfer means to continuously sublimate and dry the frozen substance.

(2) In the configuration of the above (1), the plurality of regions of the three or more regions comprise at least a temperature region of a minus temperature, a temperature region in a range from the minus temperature to plus 40° C., and a temperature region of 20° C. or higher, provided toward a direction from the inlet portion to the outlet portion respectively.

(3) In the configuration of the above (1) or (2), a substance produced therefrom is an injectable substance or a drug in solid formulation, and a periphery of a tubular member is covered with clean air.

(4) In the configuration of the above (1) to (3), the rotating portion comprises a rotational drive transmitting portion for transmitting rotational drive provided in one or a plurality of locations in an axial direction, and a rotation support portion configured by a rotary roller and/or a bearing for supporting rotation by the rotational drive transmitting portion.

(5) In the configuration of the above (1) to (4), the rotating portion has a rotation speed of 1/30 rpm or more and 1 rpm or less.

(6) In the configuration of the above (1) to (5), the transfer means is formed by providing a spiral wall portion in an inner wall of the tubular member.

(7) In the configuration of the above (1) to (5), the transfer means is configured by a groove portion formed in an inner wall of the tubular member, and the depth of the groove portion is 3 mm or more and 50 mm or less.

(8) In the configuration of the above (1) to (7), the tubular member includes a contact type or non-contact type temperature detection unit, and the temperature control unit controls a temperature of the temperature adjusting means according to a surface temperature of the tubular member or a temperature of a substance in the tubular member detected by the temperature detection unit.

(9) In the configuration of the above (1) to (8), a moisture detection unit is provided outside the tubular member for detecting a moisture content of a substance in the tubular member through a transparent glass or resin window portion, and the temperature control unit controls a temperature of the temperature adjusting means according to the moisture content of a substance in the tubular member detected by the moisture detection unit.

(10) In the configuration of the above (1) to (9), the tubular member is made of stainless steel.

(11) The present invention provides a vacuum freeze-drying method comprising a vacuum freezing step for freezing a liquid, a drying step for sublimating and drying a frozen substance frozen as above, and a step for performing vacuum suction through an exhaust path. The drying step comprises a step for rotating a tubular member formed of a tubular shape having an inlet portion and an outlet portion, wherein the tubular member has a spiral transfer means continuously provided adjacent to an inner wall of the tubular member toward a direction from the inlet portion to the outlet portion, a step for adjusting temperatures of a plurality of regions provided toward a direction from the inlet portion to the outlet portion in a peripheral portion of the tubular member, wherein the plurality of regions are at least three or more regions whose temperature is capable of being controlled, and a step for continuously sublimating and drying the frozen substance entering from the inlet portion while the frozen substance is transferred sequentially to locations corresponding to the plurality of regions in the tubular member.

(12) In the configuration of the above (1) to (10), The connecting portion is configured that by a rotation of screw arranged in a transfer pipe having one end facing the collecting portion of the vacuum freezing device and the other end facing the inside of the tubular portion, the frozen material entering from the collecting portion is moved in the axial direction of the screw.

(13) In the configuration of the above (12), a base end portion of the screw on the vacuum freezing device side is bearing by a bearing portion, a first suction port is provided in the vicinity of the bearing portion, and it is configured that the inside of the transfer pipe is constantly maintained in a vacuum through the first suction port. A tip portion of the transfer pipe on the drying device side is configured as a bearing portion to rotationally support an end member of the tubular portion of the tubular member of the drying device, a second suction port is provided between the end member and the bearing portion on the tip end side of the transfer pipe, and it is configured that the inside of the transfer pipe and the inside of the tubular portion are maintained in a vacuum through the second suction port.

(14) In the configuration of the above (12) or (13), the screw is a spiral coil structure located around a rotation axis, and provided in a state close to the inner wall of the transfer pipe. It is configured to send the frozen material received from the collecting portion to the tubular portion by a rotation of the screw.

(15) In the configuration of the above (12) to (14), the screw is rotationally driven by a rotational driving means different from the rotating portion for rotating the tubular portion.

Effect of the Invention

According to the present invention, it enables to provide a vacuum freeze-drying apparatus and a vacuum freeze-drying method capable of continuously performing vacuum freeze-drying in a short time.

EMBODIMENTS TO CARRY OUT THE INVENTION

Figure 1:
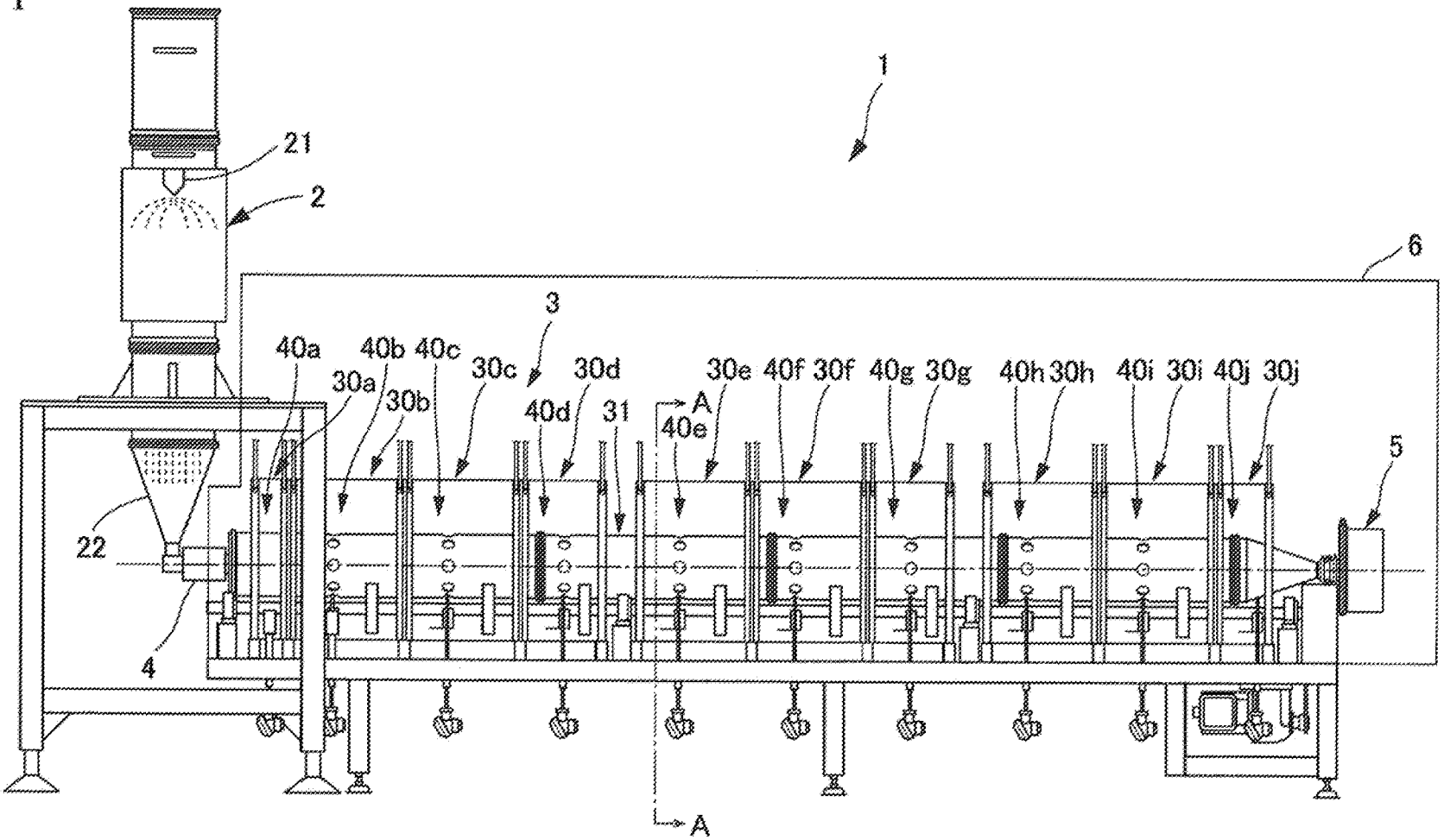
FIG. 1 is an explanatory diagram of a vacuum freeze-drying apparatus according to an embodiment to the present invention.

Next, a vacuum freeze-drying apparatus according to an embodiment to the present invention will be described. Further, the same member or a member having the same function may be designated by the same reference numeral, and the description may be omitted as appropriate after the member is described.

Figure 2:
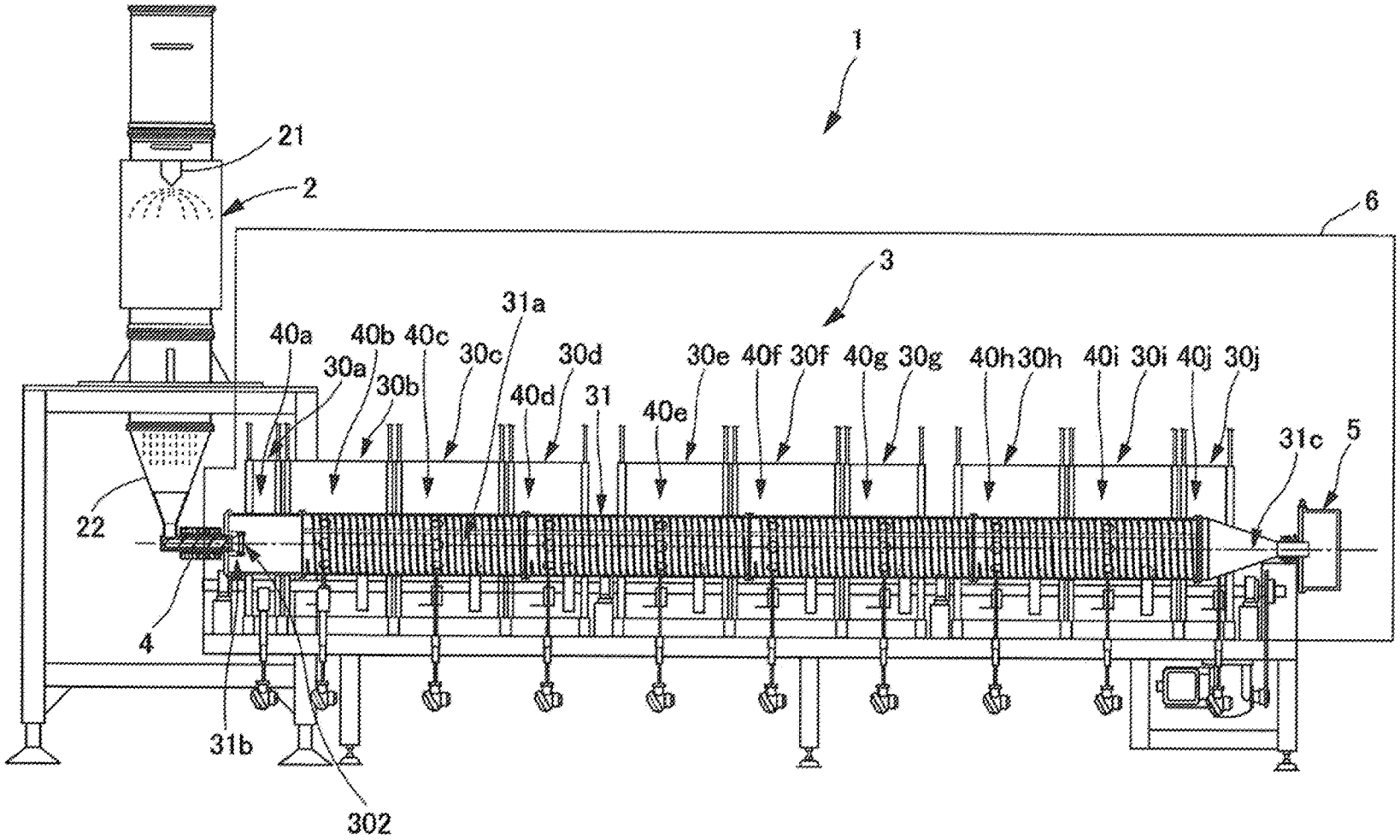
FIG. 2 shows a cross-sectional view of a drying device, a connection portion, and a collection portion in a vacuum freeze-drying apparatus of FIG. 1.

FIG. 1 is an explanatory diagram of a vacuum freeze-drying apparatus according to an embodiment to the present invention. FIG. 2 shows a cross-sectional view of a drying device, a connection portion, and a collection portion in a vacuum freeze-drying apparatus of FIG. 1.

As shown in FIG. 1, a vacuum freeze-drying apparatus 1 has a vacuum freezing device 2, a drying device 3, a connection portion 4, and a collection portion 5.

Substance handled by a vacuum freeze-drying apparatus 1 is an injectable substance or a drug in solid formulation.

A vacuum freezing device 2, for example, sprays a raw material solution containing a raw material into a vacuum container from a spray nozzle 21 to produce a frozen substance by freezing a sprayed raw material solution. Further, a vacuum freezing device may be one in which a raw material solution is dropped from a nozzle into a vacuum container, so it is enable to produce a frozen substance by freezing dropped droplets. A sprayed or dropped raw material solution self-freezes due to an evaporation of water during the fall and the deprivation of latent heat of vaporization, resulting in a frozen substance which is a fine frozen particle. A frozen substance falls toward a collecting portion 22 having a tapered shape with a smaller opening, and is collected by the collecting portion 22.

A connection portion 4 connects a vacuum freezing device 2 and a drying device 3 for transporting a frozen substance produced at a vacuum freezing device 2 to a drying device 3.

A drying device 3 is to continuously sublimate and dry a frozen substance. A collection portion 5 collects a dried material formed by sublimating and drying at a drying device 3 since it is be evolved from an outlet portion 31*c* of a tubular member 31.

A vacuum freeze-drying apparatus 1 has an exhaust path for performing vacuum suction, wherein the exhaust path is provided in a connection portion 4 according to an embodiment. The exhaust path may be provided in a vacuum freezing device 2, a drying device 3, or a connection portion 4. By providing an exhaust path, it enables to maintain reduced-pressure atmosphere inside, to make a circumstance where liquid is difficult to be present and solid or gas is present.

A tubular member 31 and a collection portion 5 are covered by clean air 6 in the periphery. Any surrounding outer surface portion of a decomposable connecting portion of a tubular member 3 is all covered by clean air 6 so that it is configured to allow clean air to enter against a leak.

Figure 3:
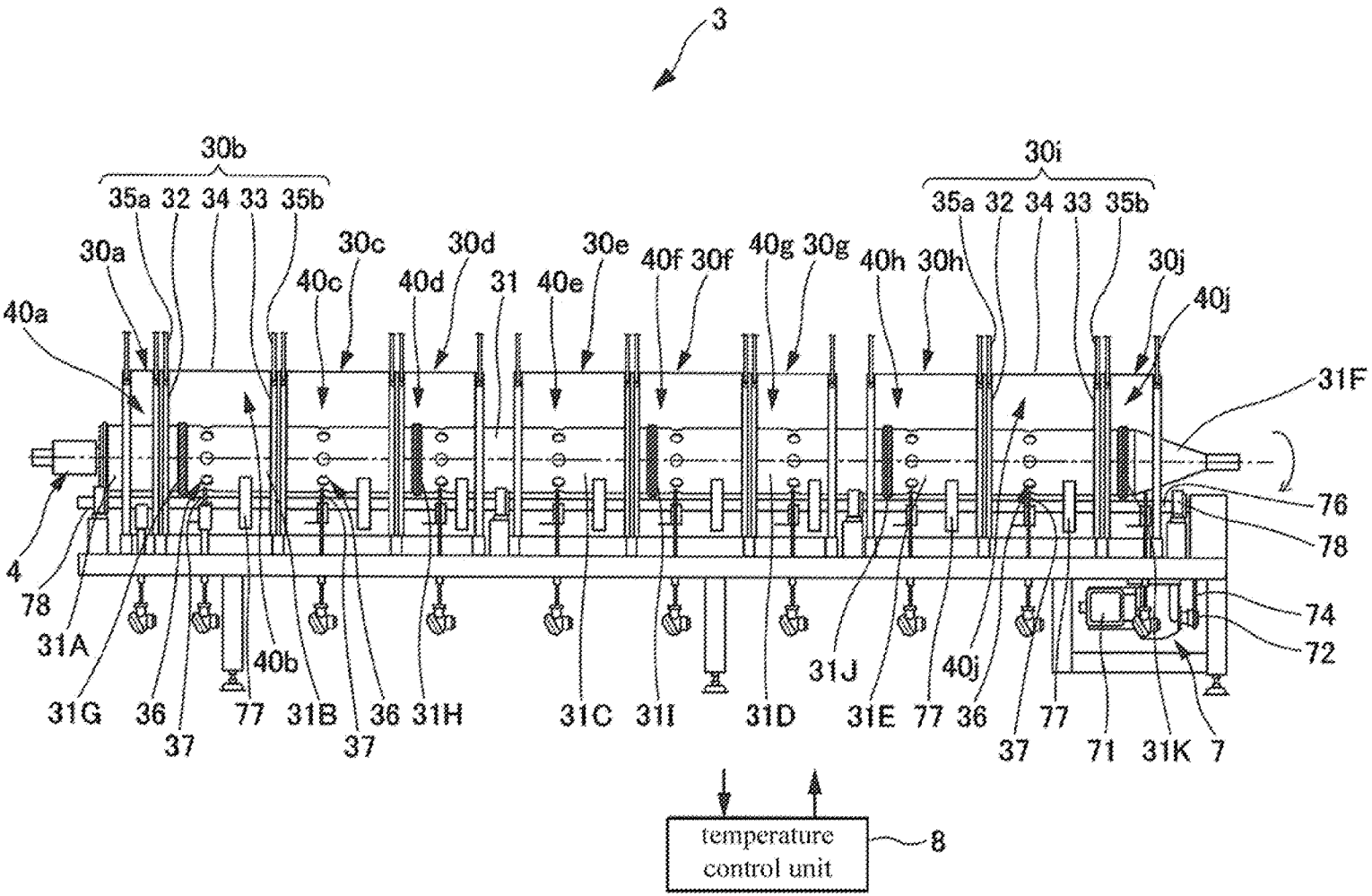
FIG. 3 is a front view of a drying device of a vacuum freeze-drying apparatus according to an embodiment to the present invention.
Figure 4:
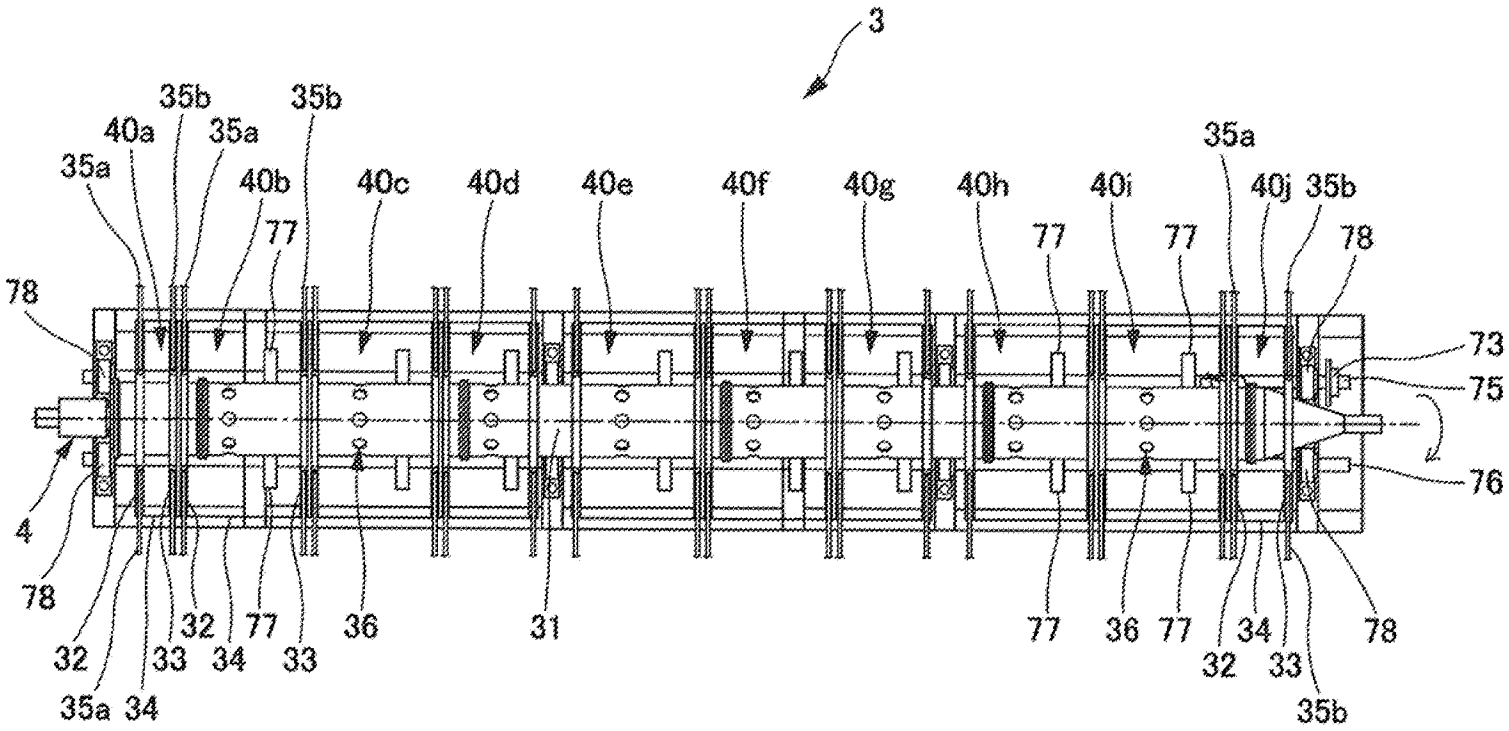
FIG. 4 is a plan view of a drying device of a vacuum freeze-drying apparatus according to an embodiment to the present invention.
Figure 5A:
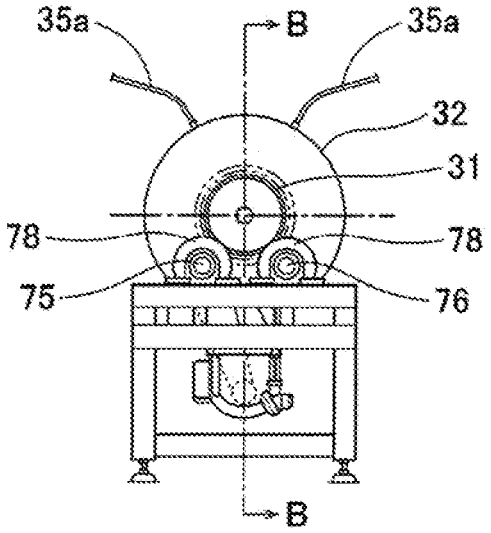
FIG. 5A is a left side view of a drying device and FIG. 5B is a right side view of a drying device.
Figure 5B:
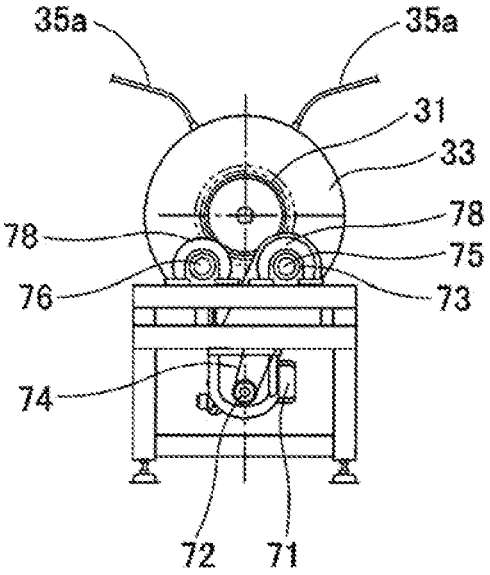
Figure 6:
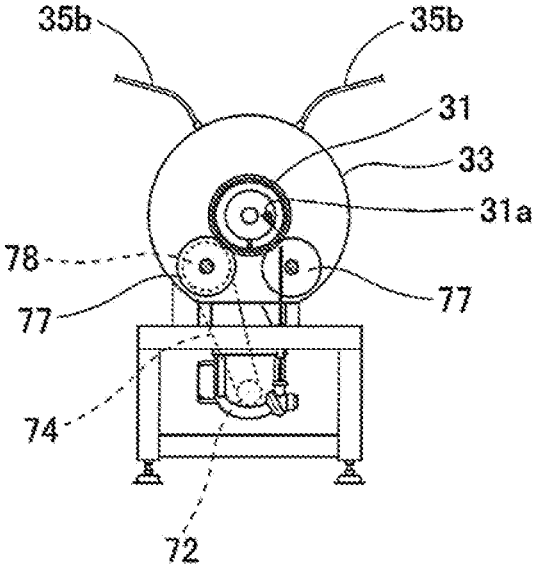
FIG. 6 is a cross-sectional view in a line from A to A of FIG. 1.

FIG. 3 is a front view of a drying device of a vacuum freeze-drying apparatus related to an embodiment of the present invention. FIG. 4 is a plan view of a drying device of a vacuum freeze-drying apparatus according to an embodiment of the present invention. FIG. 5A is a left side view of a drying device and FIG. 5B is a right side view of a drying device. FIG. 6 is a cross-sectional view of a line from A to A in FIG. 1.

As shown in FIGS. 1 to 6, a drying device 3 is provided with a tubular member 31, a temperature adjusting means 30*a* to 30*j*, a rotating portion 7, and a temperature control unit 8.

A tubular member 31 is formed of a tubular shape extending in a linear manner in a horizontal direction, having an opening, provided with an inlet portion 31*b* for letting a frozen substance enter into, and an outlet portion 31*c* for being an outlet for a dried material sublimated and dried (See FIG. 2).

In a tubular member 31, provided is a spiral transfer means 31*a* continuously provided adjacent to an inner wall of a tubular member 31 from an inlet portion 31*b* toward an outlet portion 31*c*. A frozen substance transported from a connection portion 4 enters from an inlet portion 31*b* of a tubular member 31 and is transferred to an outlet portion 31*c* by a spiral transfer means 31*a*, during which a frozen substance is continuously sublimated and dried.

Temperature adjusting means 30*a* to 30*j* are provided in an outer peripheral portion of a tubular member 31 and adjust temperatures of a plurality of regions 40*a* to 40*j* in an outer surface of a tubular member 31.

A plurality of regions 40*a* to 40*j* are provided from an inlet portion 31*b* toward an outlet portion 31*c* of a tubular member 31, and temperatures thereof can be independently controlled. Temperature adjusting means 30*a* to 30*j* adjust temperatures of locations in a tubular member 31 corresponding to a plurality of regions 40*a* to 40*j* by adjusting temperatures in a plurality of regions 40*a* to 40*j*.

Here, ten temperature adjusting means 30*a* to 30*j* are provided, so a plurality of regions formed by a temperature adjusting means 30*a* to 30*j* are provided ten. It is preferred that a plurality of regions 40*a* to 40*j* have at least 3 or more regions. It is noted that a plurality of a temperature adjusting means may be described collectively as a temperature adjusting means, or each temperature adjusting means may be described as a temperature adjusting means respectively.

A rotating portion 7 is for rotating a tubular member 31 at the center of a pivot. As a tubular member 31 is rotated by a rotating portion 7, a frozen substance entering from an inlet portion 31*b* of a tubular member 31 is sequentially transferred through a spiral transfer means 31*a* toward an outlet portion 31*c* in a tubular member 31. During the course, a frozen substance is continuously sublimated and dried. A rotating portion 7 is configured to rotate only a tubular member 31 and not to rotate temperature adjusting means 30*a* to 30*j* outside a tubular member 31. Temperature adjusting means 30*a* to 30*j* are fixed not to rotate.

A temperature control unit 8 has functions of inputting and outputting information, and independently controls temperature adjusting means 30*a* to 30*j* for adjusting temperatures of a plurality of regions 40*a* to 40*j* formed in an outer surface of a tubular member 31.

Next, temperature adjusting means 30*a* to 30*j* will be described.

As shown in FIG. 1 and FIG. 2, temperature adjusting means 30*a* to 30*j* can respectively and independently adjust a temperature of outer space around a tubular member 31 and adjust a temperature of each space in a tubular member 31 respectively.

A temperature adjusting means 30*a* adjusts a temperature of a space of a region 40*a* and adjusts a temperature of a space in a tubular member 31 corresponding to a region 40*a*. In addition, a temperature adjusting means 30*b* adjusts a temperature of a space of a region 40*b* and adjusts a temperature of a space in a tubular member 31 corresponding to a region 40*b*. A temperature adjusting means 30*c* adjusts a temperature of a space of a region 40*c* and adjusts a temperature of a space in a tubular member 31 corresponding to a region 40*c*. Similarly, temperature adjusting means 30*d* to 30*j* adjust temperatures of spaces of regions 40*d* to 40*j* and adjust temperatures of spaces in a tubular member 31 corresponding to regions 40*d* to 40*j*.

A frozen substance entering from an inlet portion 31*b* of a tubular member 31 is continuously sublimated and dried by advancing through spaces where each temperature is adjusted by temperature adjusting means 30*a* to 30*j* respectively.

Next, an example of temperature adjusting means 30*a* to 30*j* will be specifically described with reference to FIGS. 3 to 6. Although a temperature adjusting means 30*b* will be described as an example, other temperature adjust means may be configured in a similar manner. A temperature adjusting means 30*b* comprises a wall portion 32 on the side of an inlet portion 31*b* of a tubular member 31, a wall portion 33 on the side of an outlet portion 31*c*, a cover 34 for covering a space surrounded by the wall portions 32 and 33 to surround a tubular member 31, and ducts 35*a* and 35*b* for supplying gas to a wall portion 32 or 33 respectively. Wall portions 32 and 33 are both in a circular shape. A cover 34 is formed by a material such as a transparent resin so that it can visualize an interior, and is for covering a space surrounded by a wall portion 32 and a wall portion 33. A wall portion 32 and a wall portion 33 are connected to ducts 35*a* and 35*b* so that ducts 35*a* and 35*b* can supply gas. Temperatures in a plurality of regions 40*a* to 40*j* is adjusted to each target temperature by gas so supplied.

An air blowing means (not shown) is connected to ducts 35*a* and 35*b*, and a temperature-controlled gas is supplied. By supplying gas from ducts 35*a* and 35*b* into regions 40*a* to 40*j* covered by a wall portion 32, a wall portion 33 and a cover 34, temperatures in a plurality of regions 40*a* to 40*j* are independently controlled. For example, air can be supplied as gas, but it is not limited to air.

Although gas is used as an example to describe temperature adjusting means 30*a* to 30*j*, but not limited to gas, an electrical heater, refrigerant, etc. can be used.

The inside of wall portions 32, 33 has a circular opening matching an outer shape of a tubular member 31. The inside openings of wall portions 32, 33 are preferably close to an outer periphery of a tubular member 31.

Next, temperatures of a plurality of regions 40*a* to 40*j* are described.

A plurality of regions 40*a* to 40*j* has at least three or more regions from an inlet portion 31*b* toward an outlet portion 31*c* of a tubular member 31, these three or more regions include the following (1) to (3) temperature regions. A temperature region is defined by measuring a temperature of a tubular member 31 which is itself a tube at the time when the process gets to a stable operation state, in a manner of a contact type and/or a non-contact type to an outer surface of a tubular member 31.

Included are at least (1) a minus temperature region, (2) a temperature region in a range from the minus temperature to plus 40° C., and (3) a temperature region of plus 20° C. or higher.

A minus temperature region of (1) refers to a minus temperature region, such as −40° C., −30° C., −20° C., etc.

A temperature region (2) in a range from the minus temperature of (1) to plus 40° C. refers to a temperature region in a range from a minus temperature of the minus temperature region (1) to plus 40° C. For example, when a temperature of the minus temperature region of (1) is −40° C., since this −40° C. plus 40° C., a temperature region of (2) becomes a temperature region in a range from −40° C. to 0° C. Also, when a temperature of a minus temperature region of (1) is −20° C., since this −20° C. plus 40° C., a temperature region of (2) becomes a temperature region in a range from −20° C. to 20° C.

A temperature region of plus 20° C. or higher of (3) refers to a temperature region of 0° C.+20° C. or higher, when an upper limit temperature of (2) is 0° C.

From an inlet portion 31*b* toward an outlet portion 31*c* of a tubular member 31, a plurality of regions 40*a* to 40*j* include at least three regions of the above (1) to (3), a frozen substance or a dry substance is transferred by a transfer means 31*a* sequentially to locations in a tubular member 31 corresponding to a plurality of regions 40*a* to 40*j* including those (1) to (3) temperature regions, and a frozen substance or a dry substance is continuously sublimated and dried.

Next, a tubular member 31 is described.

A tubular member 31 is preferably made of stainless steel. A length of a tubular member 31 is preferably for example a range from 100 mm to 2000 mm, more preferably a range from 150 mm to 1000 mm, and more preferably a range from 200 mm to 500 mm.

A tubular member 31 is formed of one tubular shape by connecting a plurality of tubular portions 31A to 31F with attachment portions 31G to 31K. A tubular member 31 may be formed in one tubular shape without providing an attachment portion. Tubular portions 31B, 31C, 31D, 31E are formed by tubular portions of the same shape. A tubular portion 31A is one having a slightly shorter length. A tubular portion 31F is formed so that the cross-sectional shape becomes smaller toward the tip. Attachment portions 31G to 31K connect firmly adjacent tubular portions so as not to come off.

As described above, a tubular member 31 is provided with a spiral transfer means 31*a* continuously provided adjacent to an inner wall of a tubular member 31 from an inlet portion 31*b* toward an outlet portion 31*c*. The transfer means 31*a* can form a spiral shape by providing a wall portion or a groove in an inner periphery of a tubular member 31. The formation of a spiral shape also includes a method of embedding a screw in an inner periphery of a tubular member 31.

A transfer means 31*a* transfers a frozen substance entering from an inlet portion 31*b* sequentially in a tubular member 31 located inside of a plurality of regions 40*a* to 40*j*, continuously sublimating and drying a frozen substance, and guide a dry substance sublimated and dried to an outlet portion 31*c*.

Next, a configuration of a rotating portion will be described.

As shown in FIGS. 3 to 6, a rotating portion 7 is provided with a motor 71, pulleys 72, 73, a belt 74, rotational shafts 75, 76 and rotary rollers 77, 78.

A motor 71 is a rotational drive source. Pulleys 72, 73, a belt 74 and rotational shafts 75, 76 function as rotational drive transmitting portions for transmitting rotational drive. Rotary rollers 77, 78 are a rotation support portion for supporting a rotation by a rotational drive transmitting portion. A rotation support portion may be configured by adding a bearing to rotary rollers 77, 78, and configured by replacing a rotary roller 77 with a bearing.

A belt 74 is hanged on the pulleys 72 and 73. Rotational force of a motor 71 is transmitted via a belt 74. A rotary roller 77 is arranged below on both sides of a tubular member 31. A tubular member 31 is placed on a rotary roller 77 arranged on both sides.

A pulley 73 is attached near one end of a rotational shaft 75. A rotating roller 78 attached to a fixed base is provided inside a pulley 73, and a rotary roller 78 similarly attached to a fixed base is also provided at the other end of the rotating shaft 75. Between rotary rollers 78 and 78, eight rotary rollers 77 are attached to a rotational shaft 75.

A rotational shaft 76 has a rotary roller 78 attached to a fixed base on the one end, and has a rotary roller 78 attached to a fixed base on the other end. Between these rotary rollers 78 and 78, eight rotary rollers 77 are attached to a rotational shaft 76. Rotary rollers 77 attached to a rotational shaft 75 are driving rollers, and rotary rollers 77 attached to a rotational shaft 76 are driven rollers.

When a motor 71 rotates, a belt 74 rotates through a pulley 72, a rotational shaft 75 rotates by a rotation of a pulley 73, and by a rotation of rotary roller 77 fixed to a rotational shaft 75, a tubular member 31 rotates, and a rotary roller 77 rotates as a driven roller attached to a rotational shaft 76.

Next, a rotation speed of a tubular member 31 will be described.

It is preferred that a tubular member 31 rotates by a rotating portion 7 at a rotation speed of 1/30 rpm or more and 1 rpm or less.

Next, a temperature detection unit and a moisture detection unit will be described.

As shown in FIGS. 3 and 4, in a tubular member 31 glass windows (window portion) 36 are continuously provided at a certain intervals in a circumferential direction, and the glass windows 36 are provided at a plurality of locations (eight locations in the present embodiment) in a longitudinal direction of a tubular member 31. The glass window 36 is provided so that a state of a substance inside can be recognized and detected from outside. A glass window 36 may be made of resin.

A detection unit 37 is provided at the lower portion of a tubular member 31 where a glass window 36 is provided in a circumferential direction. A detection unit 37 includes at least three types, and includes a temperature detection unit for detecting a temperature of a substance inside a tubular member 31, a temperature detection unit for detecting a temperature of an outer surface (wall surface) of a tubular member 31, and a moisture detection unit for detecting the amount of moisture of a substance inside a tubular member 31.

When a detection unit 37 functions as a temperature detection unit for detecting a temperature of a substance inside a tubular member 31, it can be configured as a contact type or a non-contact type. When a detection unit 37 functioning as a temperature detection unit is a contact type, it detects a surface temperature of a tubular member 31. When a detection unit 37 functioning as a temperature detection unit is a non-contact type, it detects a temperature of a substance inside a tubular member 31 through a glass window 36 of a tubular member 31.

A temperature control unit 8 is capable of independently controlling temperatures of temperature adjusting means 30*a* to 30*j*, according to a surface temperature of a tubular member 31 or a temperature of a substance inside a tubular member 31 through a glass window 36 which a detection unit 37 detects.

Further, when a detection unit 37 functions as a moisture detection unit for detecting the amount of moisture of a substance inside a tubular member 31, it is capable of detecting the amount of moisture of a substance inside a tubular member 31 through a transparent glass window 36. A temperature control unit 8 is capable of independently controlling temperature of temperature adjusting means 30*a* to 30*j*, according to the amount of moisture of a substance inside a tubular member detected by a detection unit 37.

Figure 9:
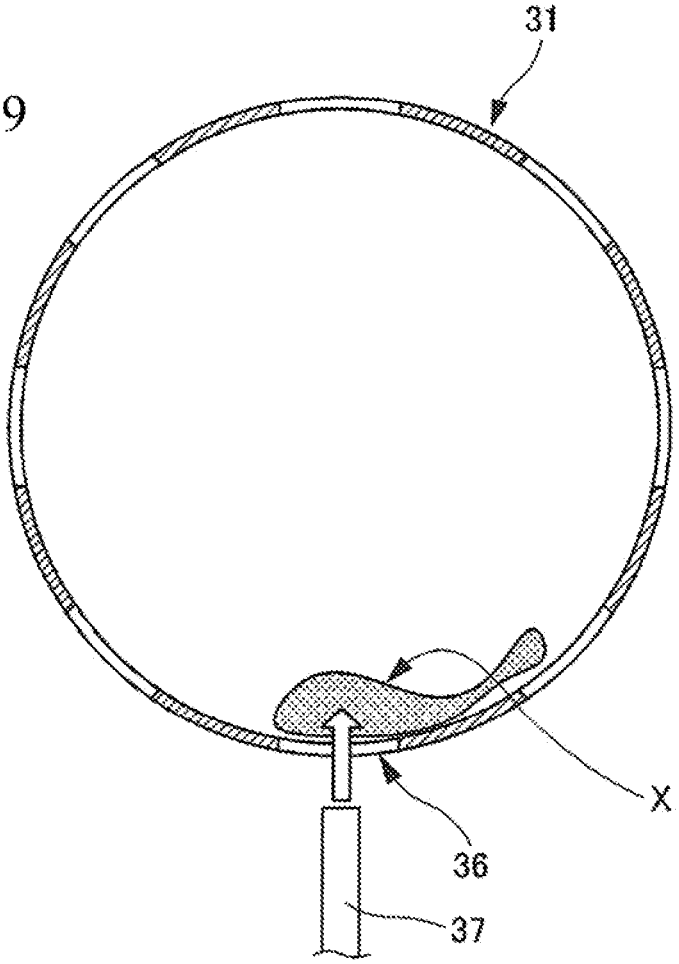
FIG. 9 shows how a detection unit detects a temperature of substance or the amount of moisture of a substance inside.

FIG. 9 shows how a detection unit detects a temperature of a substance or the amount of moisture of a substance inside.

As shown in FIG. 9, when a detection unit 37 function as a temperature detection unit for detecting a temperature of a substance inside a tubular member 31 and as a moisture detection unit for detecting the amount of moisture of a substance inside a tubular member 31, it is capable of detecting temperature of a substance X inside a tubular member 31 and a moisture of a substance inside a tubular member 31 through a transparent glass window 36 of a tubular member 31.

A detection unit 37 is capable of detecting a temperature of a substance X inside a tubular member 31 and the amount of moisture of a substance inside a tubular member 31 through each of transparent glass windows 36 provided at a certain intervals in a circumferential direction of a tubular member 31. Also, since glass windows 36 and detection units 37 are provided at a plurality of positions in a longitudinal direction of a tubular member 31, a temperature and the amount of moisture of a substance can be accurately detected at each position of the tubular member 31 respectively.

Next, a transfer means 31*a* will be described.

Figure 7A:
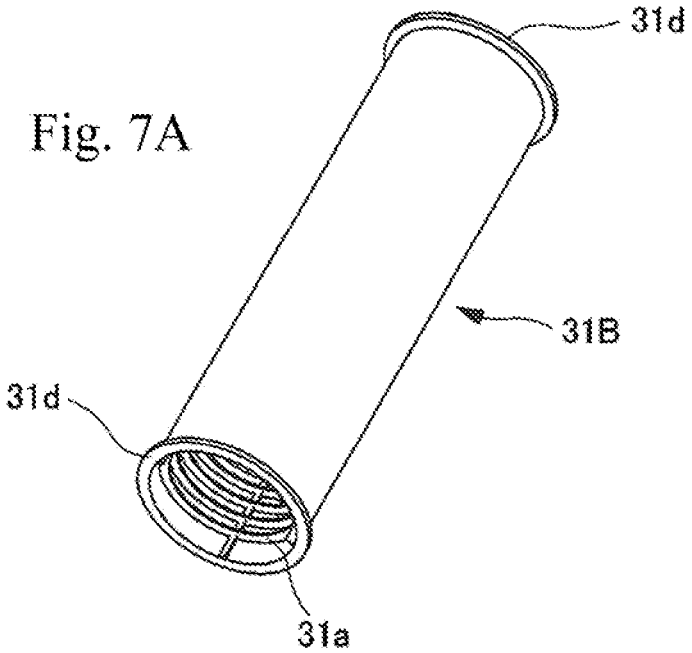
FIGS. 7A to 7E show a tubular portion 31B among a plurality of tubular portions 31A to 31F constituting a tubular member 31.
Figure 7C:
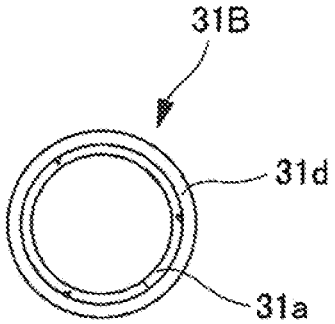
Figure 7B:
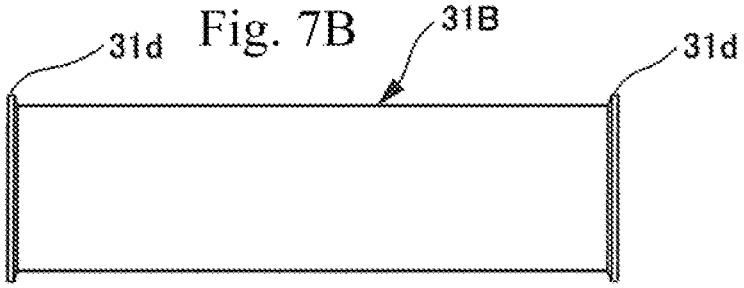
Figure 7D:
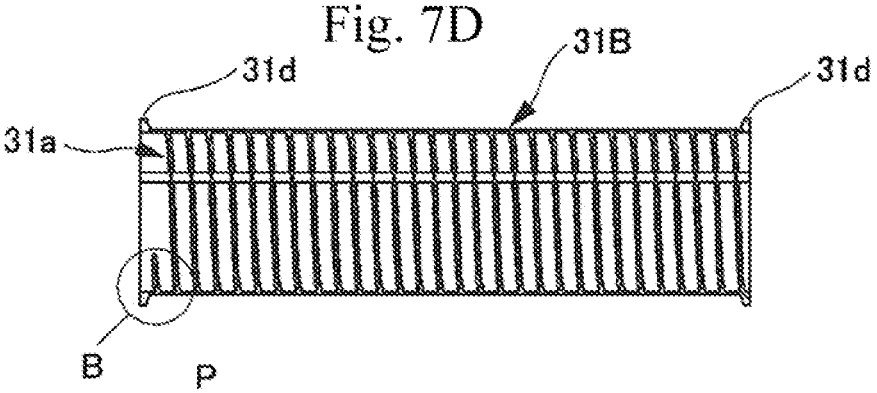
Figure 7E:
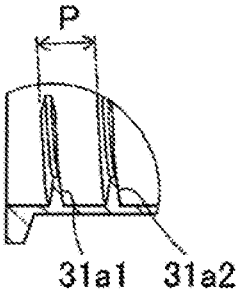
Figure 8:
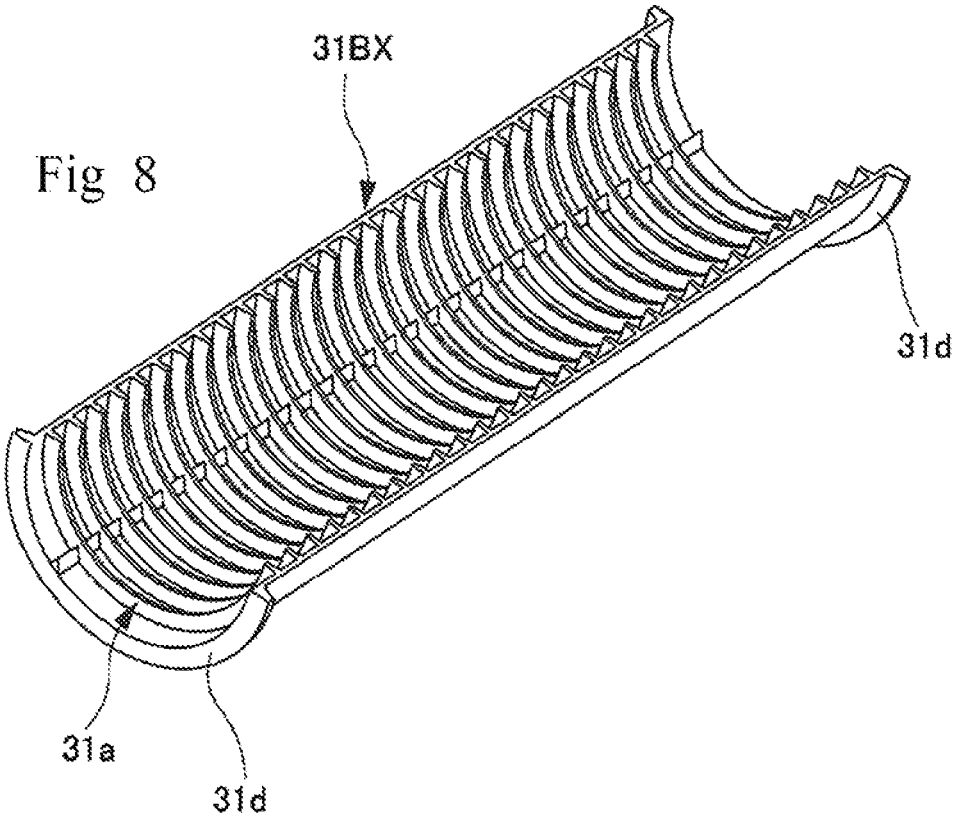
FIG. 8 shows a half body 31BX of a tubular portion 31B.

FIGS. 7A to 7E show a tubular portion 31B among a plurality of tubular portions 31A to 31F constituting a tubular member 31. FIG. 7A is a perspective view of a tubular portion 31B shown in FIG. 3, FIG. 7B is a front view of a tubular portion 31B, FIG. 7C is a side view of a tubular portion 31B, FIG. 7D is a cross-sectional view of a tubular portion 31B, and FIG. 7E is a figure enlarging a B portion of FIG. 7D. FIG. 8 shows a half body 31BX of a tubular portion 31B.

In addition, in FIGS. 7 and 8, a showing of glass window 36 is omitted since a spiral transfer means 31*a* is centered in a tubular portion 31B of FIG. 3.

As shown in FIGS. 7 and 8, a tubular portion 31B constituting a tubular member 31 is formed of a tubular shape, and edge portions 31*d* protruding in a radial direction in both sides of an opening end are formed. One tubular member 31 is formed by fixing edge portions 31*d* each other of adjacent tubular portions of 31A to 31F. The edge portions 31*d* each other of adjacent tubular portions of 31A to 31F are fixed by connecting ferrules, clamping, or bolting.

A part of a spiral transfer means 31*a* is continuously formed in a tubular portion 31B from one end to the other end.

As shown in FIG. 7E, a wall portion is continuously formed in an inner wall of a tubular portion 31BX as a part of a transfer means 31*a*, such as a wall portion 31*a*1 in first lap and a wall portion 31*a*2 in a second lap, so that a part of a transfer means 31*a* can be formed in a tubular portion 31BX.

A height of a wall portion 31*a*1 and a wall portion 31*a*2 is a height of a transfer means 31*a*, and is preferably configured in a range of, for example, 3 mm or more and 50 mm or less.

A pitch of a wall portion 31*a*1 and a wall portion 31*a*2 is a pitch of a spiral transfer means 31*a*, and is preferably configured in a range of, for example, 5 mm or more and 20 mm or less.

FIG. 8 shows a half body 31BX of a tubular portion 31B, by combining two of these half bodies 31BX, one tubular portion 31B is constituted. A half body 31BX of a tubular portion 31B is capable of forming a part of a spiral transfer means 31*a* in a tubular portion 31B when the two are combined.

Figure 10:
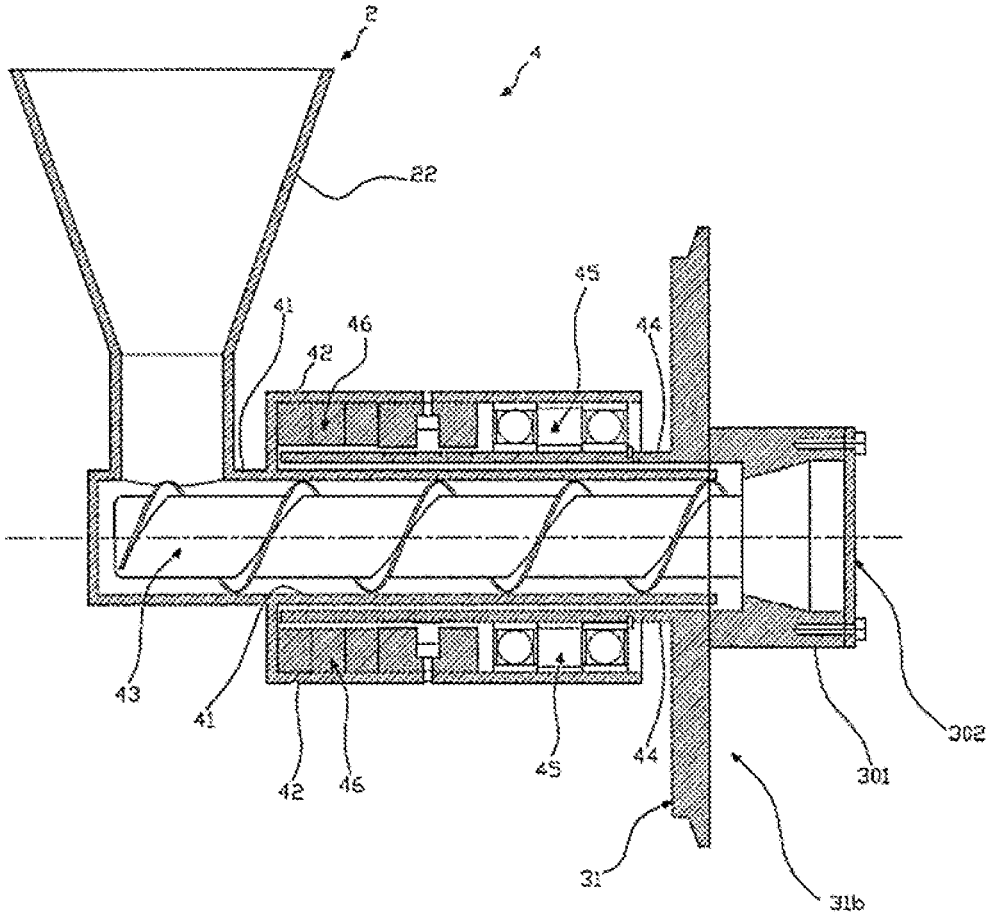
FIG. 10 is a cross-sectional view of a connection portion of a vacuum freeze-drying apparatus according to an embodiment.

FIG. 10 is a cross-sectional view of a connection portion of a vacuum freeze-drying apparatus according to an embodiment.

As shown in FIG. 10, a connection portion 4 is provided between a collecting portion 22 of a vacuum freezing device 2 and an end portion in an inlet 31*b* side of a drying device 3, is for transporting a frozen substance produced by a vacuum freezing device 2 to a drying device 3. Near an end portion 301, a receiving port 302 is provided for receiving a frozen substance transported by a connection portion 4.

A connection portion 4 comprises an inner pipe portion 41, an outer pipe portion 42, a screw 43 provided in the inner pipe portion 41, and an intermediate pipe portion 44 extending from an end portion 301 of a drying device 3 to an inner pipe portion 41 and an outer pipe portion 42 of a connection portion 4. Between an outer pipe portion 42 and an intermediate pipe portion 44, a bearing 45 and an air seal 46 are provided from a drying device 3 side.

An air seal 46 is for sealing a rotating shaft by supplying air from a flow path without contacting a rotating shaft.

Figure 11:
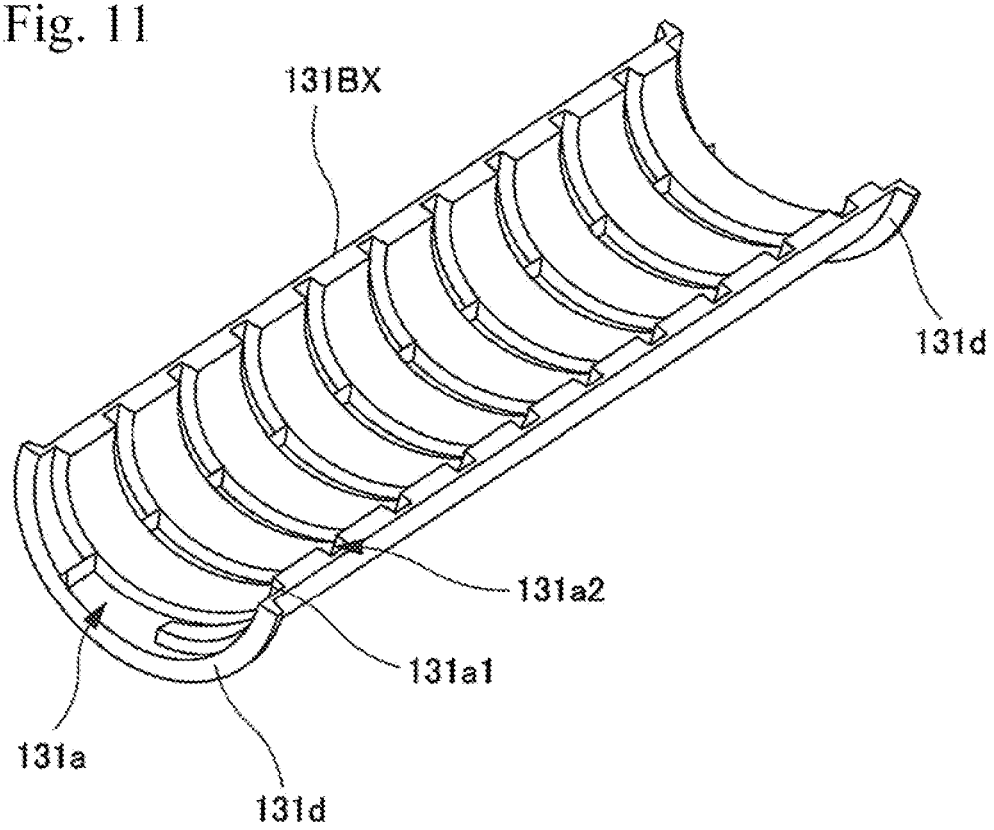
FIG. 11 is a diagram showing another example of a half body 31BX of a tubular portion 31B in FIGS. 7A to 7E.

FIG. 11 is a diagram showing another example of a half body 31BX of a tubular portion 31B of FIGS. 7A to 7E.

In examples shown in FIGS. 7 and 8, a wall portion is formed in an inner wall of a tubular member 31 to form a transfer means 31*a*. But as shown in FIG. 11, groove portions 131*a*1, 131*a*2 . . . may be formed in an inner wall of a tubular member 31 to form a transfer means 131*a*.

A tubular portion 31B is capable of forming one tubular portion 31B by connecting two half bodies 131BX. When two half bodies 131BX of a tubular portion 31B are connected, groove portions forming a spiral transfer means 131*a* are respectively formed continuously. A depth of a groove portion 131*a*1 and a groove portion 131*a*2 is a depth of a transfer means 131*a*, and is preferably configured in a range of, for example, 3 mm or more and 50 mm or less. A pitch of a groove portion 131*a*1 and a groove portion 131*a*2 is a pitch of a transfer means 131*a*, and is preferably configured in a range of, for example, 5 mm or more and 20 mm or less.

By forming a spiral groove portion in an inner periphery surface of a tubular member 31 as a transfer means 131*a* centered on a rotating shaft, a spiral feeding action inside of a tubular member 31 is imparted, and a frozen substance or a dry substance can be transferred continuously.

According to the present embodiment, it is possible to provide a vacuum freeze-drying apparatus and a vacuum freeze-drying method capable of continuously performing vacuum freeze-drying in a short time.

A vacuum freeze-drying method of the present embodiment includes a vacuum freezing step of freezing a liquid, a drying step of sublimating and drying a frozen substance frozen, and a step of performing vacuum suction through an exhaust path. The drying step comprises a step of rotating a tubular member 31 which is a tubular member 31 formed of a tubular shape having an inlet portion 31*b* and an outlet portion 31*c*, having a spiral transfer means 31*a* continuously provided adjacent to an inner wall of a tubular member 31 from an inlet portion 31*b* toward an outlet portion 31*c*, a step of adjusting temperatures of a plurality of at least three or more regions 40*a* to 40*j* provided from an inlet portion 31*b* toward an outlet portion 31*c* in a peripheral portion of a tubular member 31, whose temperatures are capable of being controlled, and a step of continuously sublimating and drying the frozen substance entering from an inlet portion 31*b*, while transferring the frozen substance sequentially to locations corresponding to a plurality of regions 30*a* to 30*j* in a tubular member 31 by a transfer means 31*a*.

Figure 12:
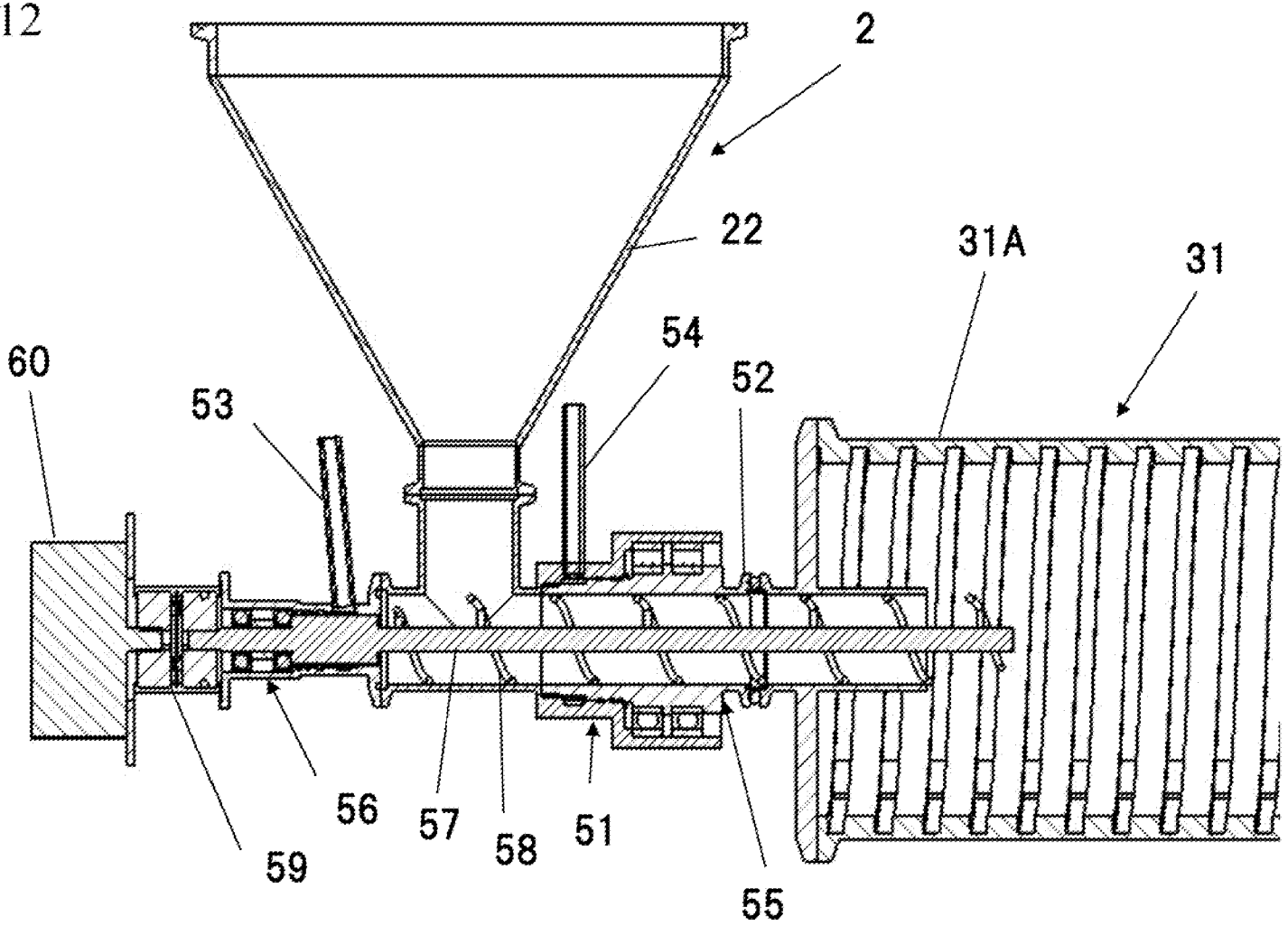
FIG. 12 is a cross-sectional view of a connection portion of a vacuum freeze-drying apparatus according to another example of an embodiment of the present invention.

Next, another structure of the connection portion 4 will be described with reference to FIG. 12. FIG. 12 is a cross-sectional view of the connection portion 4B of the vacuum freeze-drying apparatus according to another embodiment of the present invention.

First, in the vacuum freeze-drying apparatus provided with a vacuum freeze device 2 for freezing the liquid and a drying device 3 for sublimating and drying the frozen product, configured to move the frozen product from the vacuum freeze device 2 to the drying device 3 through the connection portion 4B, the connection portion 4B is configured so that the frozen product is moved by a screw 58 provided in the transfer pipe 55 facing the collecting section 22 of the vacuum freezing device 2 in the axial direction. However, the transfer of the screw 43 does not necessarily in the horizontal direction, and the frozen product may be transferred to the tubular portion 31.

The base end portion (left end portion) of the screw 58 is supported by a bearing portion 56 (here, a bearing), a first suction port 53 is provided in the vicinity of the bearing portion, and it is configured that the inside of the transfer pipe 55 is maintained to constantly be in a vacuum (a high degree of vacuum is sufficient). The first suction port 53 is connected to a vacuum pump, but illustration and description thereof will be omitted.

A tip portion of the transfer pipe 55 is configured to be a bearing portion 51, configured to rotationally support an end member 52 of the tubular portion 31A of the tubular portion 31 of the drying device. And a second suction port 54 is provided facing between the end member 52 and the bearing portion 51, it is configured that the inside of the transfer pipe 55 and the inside of the tubular portion 31 are maintained to in a vacuum. The suction port 54 is connected to the vacuum pump, but illustration and description thereof will be omitted here.

The screw 58 is a spiral coil structure arranged around a rotating shaft 57, and provided in a state close to the inner wall of the transfer pipe 55, and it is configured that the frozen material received from the collecting portion 22 is fed into the tubular portion 31 by the rotation thereof. The coil structure may be spiral shape, and may be a structure in which fragments form a substantial coil, and in short, it may be a structure capable of exhibiting a continuous feed function. The above-mentioned close state provision is to provide a clearance between the coil structure and the transfer pipe 55 so that the frozen material is not to be caught and damaged.

A motor 60 for driving and a coupling 59 for transmitting the driving force of the motor 60 to the rotating shaft 57 are arranged at an end of the rotating shaft 57 opposite side to the tubular portion 31. As described above, by providing a motor 60 for rotationally driving the screw 58 separately from the motor 71 for rotationally driving the tubular portion 31, it is possible to arbitrarily change the transport of the frozen material to the drying device 3, for example upping the rotation speed of the motor 60, to increase the transport amount. Further, in the connection portion 4 (see FIG. 10), since the end portion of the screw 43 on the drying device 3 side is necessary mechanically connected to the tubular portion 31A of the tubular portion 31, the structure of the boundary portion between the connection portion 4 and the tubular portion 31 becomes complicated, although in the connection portion 4B of an another form, since the tip of the screw 58 enters in the tubular portion 31, there is an advantage that a transport of the frozen material can be efficiently done.

Although the present invention has been described using above embodiments, it goes without saying that the technical scope of the present invention is not limited to the scope of the above embodiments, and it is clear to those skilled persons in the art that various modifications or improvements added to the above embodiments are possible. Further, it is clear from the description of the scope of claims that the form to which such modifications or improvements are added may be included in the technical scope of the present invention.

DESCRIPTION OF INDEXES

1 Vacuum freeze-drying apparatus
2 Vacuum freezing device
3 Drying device
4 Connection portion
4B Connection portion
6 Clean air
7 Rotating portion
8 Temperature control unit
30*a* to 30*j* Temperature adjusting means
31 Tubular member
31*a* Spiral transfer means
36 Glass window (window portion)
37 Detection unit (temperature detection portion, moisture detection portion)
40*a* to 40*j* Regions
46 Air seal

The invention claimed is:

1. A vacuum freeze-drying apparatus comprising:

a vacuum freezing device for freezing a liquid, and a drying device for sublimating and drying a frozen substance frozen by the vacuum freezing device, the vacuum freeze-drying apparatus comprises an exhaust path for performing vacuum suction in order to create a reduced pressure atmosphere inside the vacuum freezing device and the drying device, wherein the drying device comprises:

one tubular member formed of a tubular shape provided with an inlet portion and an outlet portion, a temperature adjusting means for respectively adjusting temperatures of a plurality of regions formed from the inlet portion toward the outlet portion in a peripheral portion of the tubular member, wherein the plurality of regions are at least three or more regions whose temperature is capable of being controlled, a temperature control unit for independently and respectively controlling the temperature of the plurality of regions by the temperature adjusting means, and a rotating portion for rotating the tubular member, the tubular member has a spiral transfer means continuously provided in an inner wall of the tubular member from the inlet portion toward the outlet portion, the vacuum freeze-drying apparatus comprises a connection portion for connecting the vacuum freezing device and the drying device is provided, wherein the connection portion comprises a first pipe portion in a side of the vacuum freezing device, a second pipe portion in a side of the drying device, and a seal portion for sealing between the first pipe portion and the second pipe portion, the tubular member comprises a plurality of tubular portions and an attachment portion for coupling the plurality of tubular portions, the temperature adjusting means is provided in each of the temperature regions, and comprises a first wall portion, a second wall portion, a cover for covering a space surrounded by the first wall portion and the second wall portion as the region, and a supply means for supplying gas inside of the region, at least a part of the tubular member having the plurality of tubular portions and the attachment portion is covered so as to be surrounded by the cover, by having the rotating portion rotate the tubular member under the reduced pressure atmosphere inside the vacuum freezing device and the drying device, the spiral transfer means transfers the frozen substance entering from the vacuum freezing device sequentially to locations corresponding to the plurality of regions in the tubular member so as to continuously sublimate and dry the frozen substance, and the connection portion is configured that by a rotation of a screw placed in a transfer pipe having one end facing a collecting portion of the vacuum freeze device, and the other end facing the inside of the tubular portion, the frozen substance entering from the collecting portion is moved in the axial direction of the screw.

2. The vacuum freeze-drying apparatus according to claim 1, wherein a base end portion of the screw on the vacuum freezing device side is bearing by a bearing portion, a first suction port is provided in a vicinity of the bearing portion, and it is configured that the inside of the transfer pipe is constantly maintained in a vacuum through the first suction port, and a tip portion of the transfer pipe on the drying device side is configured as a bearing portion to rotatably support an end member of the tubular portion of the tubular member of the drying device, and a second suction port is provided facing between the end member thereof and the bearing portion on the tip end side of the transfer pipe, and it is configured that the inside of the transfer tube and the inside of the tubular portion are maintained in a vacuum through the second suction port.

3. The vacuum freeze-drying apparatus according to claim 1, wherein the screw is a spiral coil structure located around a rotation axis, and is provided in a state close to the inner wall of the transfer pipe, and it is configured that by the rotation, the frozen substance received from the collecting portion is send to the tubular member.

4. The vacuum freeze-drying apparatus according to either of claim 1, wherein the screw is rotationally driven by a rotation driving means different from the rotating portion for rotating the tubular member.

* * * * *